US006997634B2

(12) United States Patent
Zheng

(10) Patent No.: US 6,997,634 B2
(45) Date of Patent: Feb. 14, 2006

(54) FOLDING JOINT ARRANGEMENT FOR FOLDABLE FURNITURE

(76) Inventor: Edward Zheng, 1736 Wright Ave., La Verne, CA (US) 91750

( * ) Notice: Subject to any disclaimer, the term of this patent is extended or adjusted under 35 U.S.C. 154(b) by 0 days.

(21) Appl. No.: 10/281,042

(22) Filed: Oct. 28, 2002

(65) Prior Publication Data

US 2004/0081510 A1 Apr. 29, 2004

(51) Int. Cl.

| | |
|---|---|
| ***A47C 4/00*** | (2006.01) |
| ***A47C 4/28*** | (2006.01) |
| ***A47C 4/38*** | (2006.01) |

(52) U.S. Cl. ..... 403/188; 403/53; 403/119; 403/161; 403/384; 403/388; 403/400; 411/517; 297/45; 297/42

(58) Field of Classification Search ..... 403/DIG. 13, 403/52, 53, 65, 119, 161, 163–165, 384, 388, 403/400, 188; 411/517, 351; 297/42, 45
See application file for complete search history.

(56) References Cited

U.S. PATENT DOCUMENTS

| | | | | | |
|---|---|---|---|---|---|
| 615,476 | A | * | 12/1898 | Chapman | 297/45 X |
| 3,124,387 | A | * | 3/1964 | Maclern | 297/45 X |
| 3,185,164 | A | * | 5/1965 | Perez | 403/400 X |
| 3,321,222 | A | * | 5/1967 | Buncher | 403/388 |
| 4,014,591 | A | * | 3/1977 | Gittings | |
| 4,118,065 | A | * | 10/1978 | Watkins | 297/45 |
| 4,544,203 | A | * | 10/1985 | Younger et al. | 297/45 X |
| 4,555,744 | A | * | 11/1985 | Maroney et al. | 361/212 |
| 4,607,539 | A | * | 8/1986 | Arima et al. | 411/517 X |
| 4,652,047 | A | * | 3/1987 | Chan | 297/45 |
| 4,685,725 | A | * | 8/1987 | Helfrich | 297/45 |
| 5,249,760 | A | * | 10/1993 | Morimoto | 403/348 |
| 5,718,473 | A | * | 2/1998 | Lynch, Jr. | 297/45 X |
| 5,851,052 | A | * | 12/1998 | Gustafsson | 297/45 X |
| 5,876,091 | A | * | 3/1999 | Chernomashentsev | |
| 5,921,621 | A | * | 7/1999 | Cook et al. | |
| 6,045,177 | A | * | 4/2000 | Grace | 297/45 |
| 6,669,263 | B1 | * | 12/2003 | Asai | 29/434 |

* cited by examiner

*Primary Examiner*—Daniel P. Stodola
*Assistant Examiner*—Ernesto Garcia
(74) *Attorney, Agent, or Firm*—Raymond Y. Chan; David and Raymond

(57) ABSTRACT

A folding joint arrangement, which is adapted for incorporating with a foldable furniture constructed by a plurality of first and second frame tubes, includes an angle joint body, a pivot arm integrally extended from the angle joint body to define a first axis, wherein the pivot arm is adapted for pivotally connecting with one of the first frame tube such that the first frame tube is capable of rotating about the first axis of the pivot arm, and a connector arm integrally extended from the angle joint body to define a second axis perpendicularly to the first axis wherein the connector arm is adapted for pivotally connecting with one of the second frame tube such that the second frame tube is capable of rotating about the second axis of the connector arm, so as to pivotally connect the first and second frame tubes in a two-plane directional movement.

2 Claims, 6 Drawing Sheets

FOLDING JOINT ARRANGEMENT FOR FOLDABLE FURNITURE

BACKGROUND OF THE PRESENT INVENTION

1. Field of Invention

The present invention relates to a foldable furniture, and more particularly to a folding joint arrangement for the foldable furniture, which is capable of rigidly two frame tubes in a pivotally movable manner so as to provide a two-plane directional movement of the foldable furniture.

2. Description of Related Arts

A conventional foldable furniture is constructed by a plurality of metal tubes pivotally connected with other in such a manner that the foldable furniture is capable of folding into a compact size and unfolding to expanse its supporting size by means of the pivot movement of the metal tubes.

For example, a foldable c hair comprises a foldable c hair frame comprising a plurality of construction tubes to construct a back frame and a seat frame for supporting a fabric seat. The seat frame comprises a front pair, a back pair, and two side pairs of construction tubes, wherein each pair of the construction tubes are pivotally connected together where they cross via a pivot joint so that the chair frame can be easily unfolded to provide a rigid cross-support for use and be folded up for storage.

Accordingly, in order to pivotally connect two construction tubes together, a rivet which is embodied as the pivot joint is used, wherein a first longitudinal half of the rivet is rotatably and transversely penetrated through the first construction tube while a second longitudinal half of the rivet is rotatably and transversely penetrated through the second construction tube in such a manner that the two construction tubes are capable of pivotally moving within a same plane direction, as shown in FIG. 1A.

As shown in FIG. 1B, a first alternative mode of the pivot joint comprises a rivet and a U-shaped connecting member rotatably connected thereto wherein the first construction tube is rotatably connected to the rivet while the second construction tube is rotatably connected to the connecting member in such a manner that the first and second construction tubes are pivotally connected with each other to provide a two-plane direction movement. However, such pivot joint cannot provide a rigid configuration especially when a downward force is applied on the foldable furniture.

FIG. 1C illustrates a second alternative mode of the pivot joint which comprises a joint panel and a plurality of pivot walls integrally extended therefrom wherein the first and second construction tubes are pivotally connected to the pivot walls respectively in such a manner that the first and second construction tubes are capable of pivotally moving in a two-plane direction movement. However, such pivot joint can only be used as a base pivot joint or a top pivot joint since the pivot wall is allowed to pivotally connect to the end of each of the first and second construction tubes. In other words, the pivot joint will limit the unfolded size of the foldable furniture.

SUMMARY OF THE PRESENT INVENTION

A main object of the present invention is to provide a folding joint arrangement for foldable furniture, which is capable of rigidly two frame tubes in a pivotally movable manner so as to provide a two-plane directional movement of the foldable furniture.

Another object of the present invention is to provide a folding joint arrangement for foldable furniture, which can substantially connect two frame tubes with each other so as to rigidly support a downward force applied on the foldable furniture.

Another object of the present invention is to provide a folding joint arrangement for foldable furniture, which can substantially reduce a space required to pivotally connect with the frame tubes so that the size of the foldable furniture will not be limited when the foldable furniture is unfolded. In other words, the foldable furniture can be folded into a compact size for storage and carriage.

Another object of the present invention is to provide a folding joint arrangement for foldable furniture, which does not require altering the original structural design of the foldable furniture, so as to minimize the manufacturing cost of the foldable furniture incorporating with the folding joint arrangement.

Another object of the present invention is to provide a folding joint arrangement for foldable furniture, wherein no expensive or complicated structure is required to employ in the present invention in order to achieve the above mentioned objects. Therefore, the present invention successfully provides an economic and efficient solution for providing a rigid configuration for the foldable furniture.

Accordingly, in order to accomplish the above objects, the present invention provide a folding joint arrangement for a foldable furniture which is constructed by a plurality of first and second frame tubes, comprising:

an angle joint body;

a pivot arm integrally extended from the angle joint body to define a first axis, wherein the pivot arm is adapted for pivotally connecting with one of the first frame tube such that the first frame tube is capable of rotating about the first axis of the pivot arm; and a connector arm integrally extended from the angle joint body to define a second axis perpendicularly to the first axis of the pivot arm wherein the connector arm is adapted for pivotally connecting with one of the second frame tube such that the second frame tube is capable of rotating about the second axis of the connector arm.

DETAILED DESCRIPTION OF THE PREFERRED EMBODIMENT

Figure 1A:
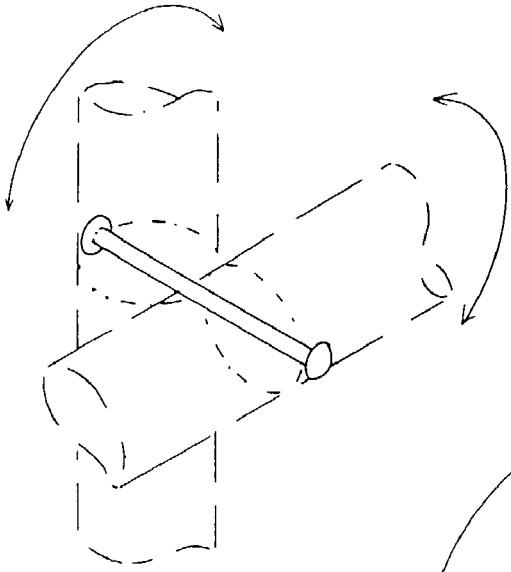
FIG 1A PRIOR ART
FIGS. 1A to 1C illustrate different types of conventional folding joints for foldable furniture.
Figure 1B:
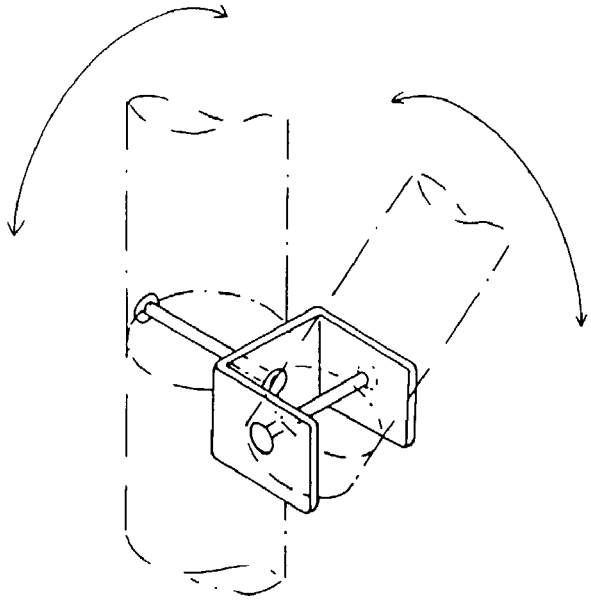
FIG 1B PRIOR ART
Figure 1C:
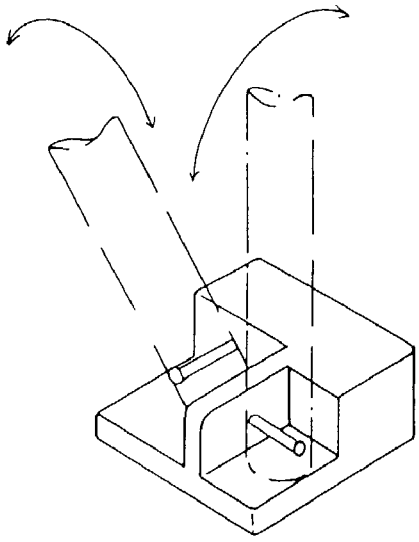
FIG 1C PRIOR ART
Figure 2:
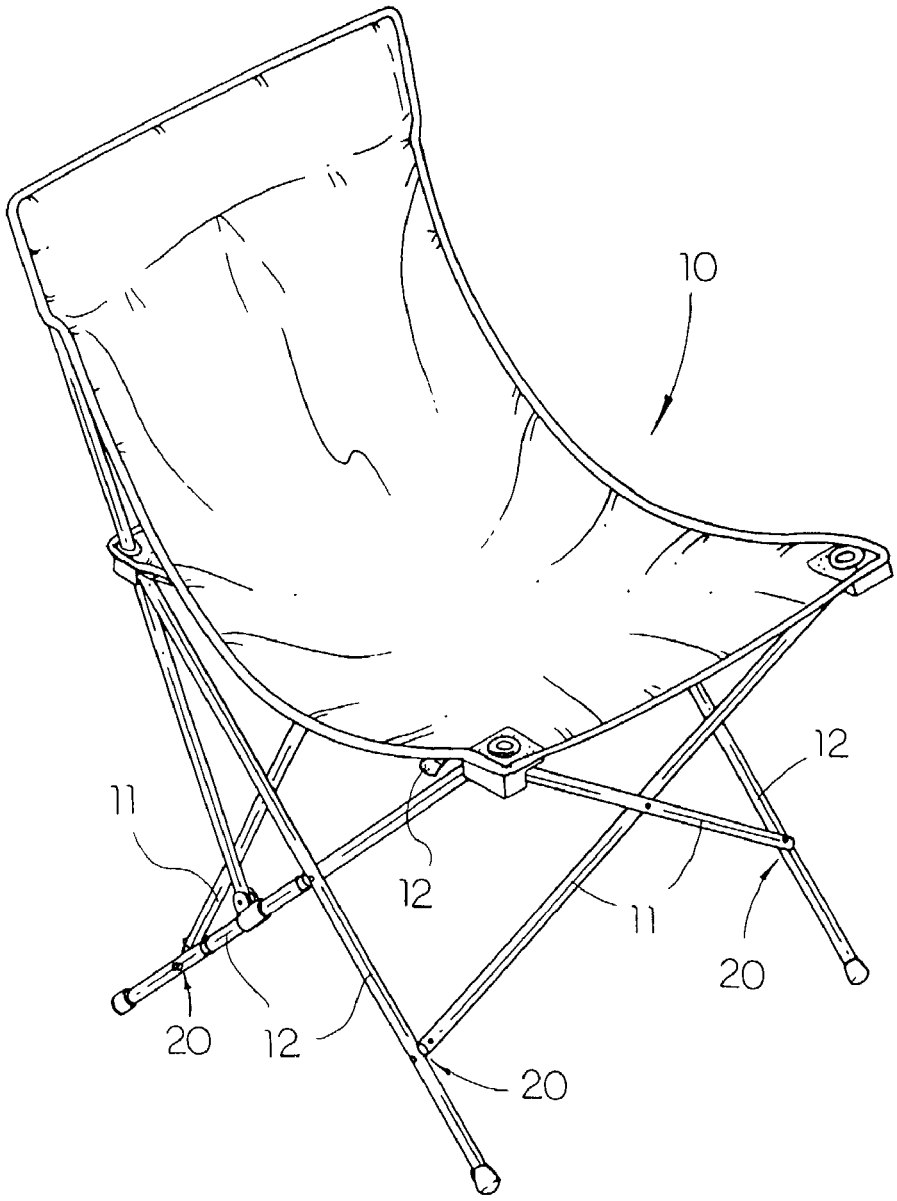
FIG. 2 is a perspective view of a foldable furniture incorporated with a folding joint arrangement according to a preferred embodiment of the present invention.
Figure 3:
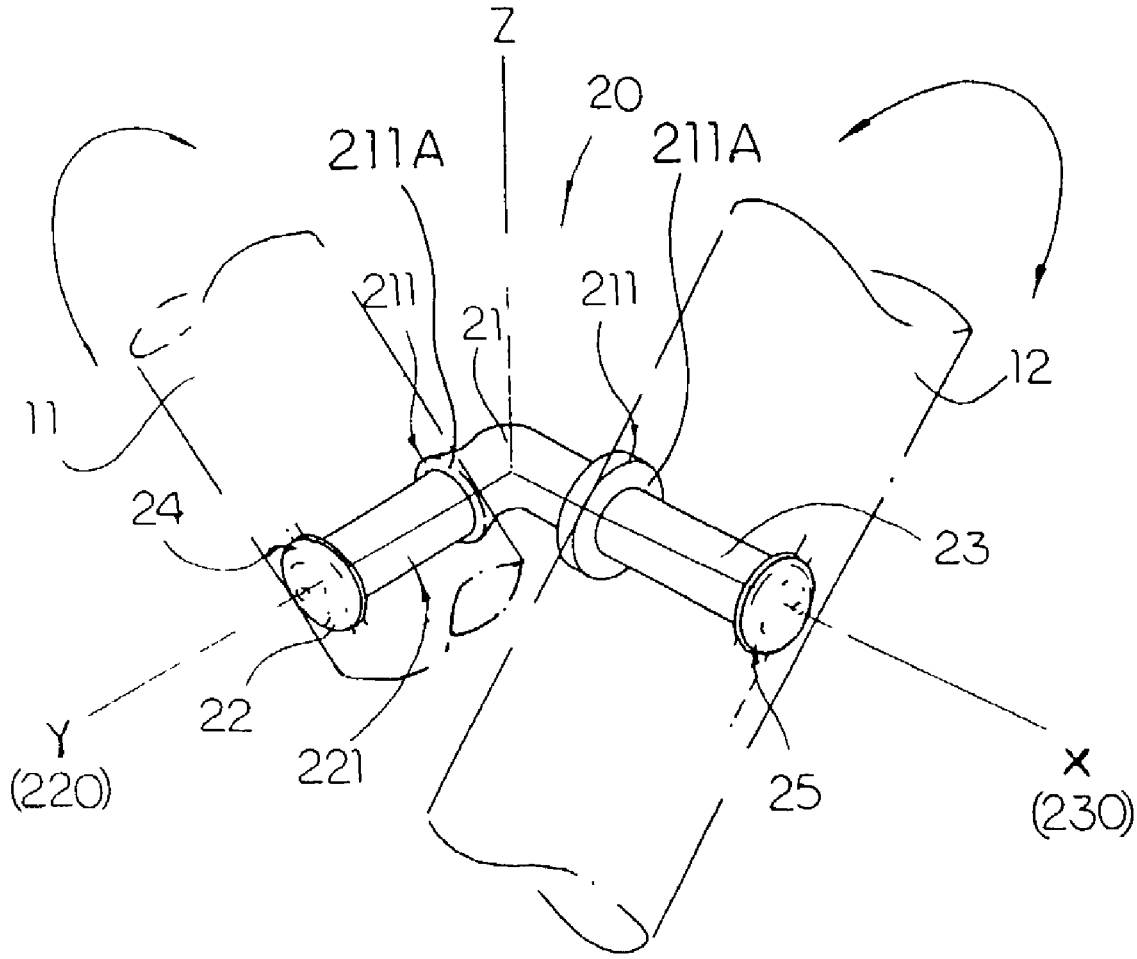
FIG. 3 is a perspective view of the folding joint arrangement according to the above preferred embodiment of the present invention.

Referring to FIGS. 2 and 3 of the drawings, a folding joint arrangement 20 incorporated with a foldable furniture 10 according to a preferred embodiment is illustrated, wherein the foldable furniture 10 is embodied as a foldable chair constructed by a plurality of first and second frame tubes 11, 12 pivotally connected with each other via the folding joint arrangement 20.

As shown in FIG. 2, the foldable chair of the foldable furniture 10 comprises a back frame and a seat frame for supporting a fabric seat. The seat frame comprises a front pair, a back pair, and two side pairs of construction tubes, wherein each of the front and rear pairs of construction tubes is embodied as the first frame tube 11 and each of the side pairs of construction tubes is embodied as the second frame tube 12.

Referring to FIG. 3, the folding joint arrangement 20 comprises an angle joint body 21, a pivot arm 22 integrally extended from the angle joint body 21 to define a first axis 220, wherein the pivot arm 22 is adapted for pivotally connecting with one of the first frame tube 11 such that the first frame tube 11 is capable of rotating about the first axis 220 of the pivot arm 22, and a connector arm 23 integrally extended from the angle joint body 21 to define a second axis 230 perpendicularly to the first axis 220 of the pivot arm 22 wherein the connector arm 23 is adapted for pivotally connecting with one of the second frame tube 12 such that the second frame tube 12 is capable of rotating about the second axis 230 of the connector arm 23, so as to pivotally connect the respective first and second frame tubes 11, 12 in a two-plane directional movement.

According to the preferred embodiment, the angle joint body 21 which is a L-shaped body has two ends provided at two perpendicular directions. Two end portions 211 are provided at the two ends in perpendicular manner, wherein the pivot arm 22 and the connector arm 23 are integrally extended from the end portions 211 of the angle joint body 21 respectively, wherein the two end portions 211 of the angle joint body 21 have two biasing surfaces 211A respectively and arranged to bias against the first and second frame tubes 11, 12 when the first and second frame tubes 11, 12 are mounted to the pivot arm 22 and the connector arm 23 respectively. Accordingly, in order to strengthen the angle joint body 21, a heat treatment is applied thereon so as to provide a rigid structure to support the first and second frame tubes 11, 12 of the foldable furniture 10.

The folding joint arrangement 20 further has a first through hole 24 transversely provided at an end portion of the first frame tube 11 and a second through hole 25 transversely provided on the second frame tube 12 wherein the pivot arm 22 and the connector arm 23 are arranged to rotatably insert into the first and second through hole 24, 25 for pivotally connecting the first and second frame tubes 11, 12 with each other.

Accordingly, the pivot arm 22 has a neck portion 221, having a length slightly larger than a width of the first frame tube 11, rotatably passing through the first through hole 24 on the first frame tube 11 such that the first frame tube 11 is adapted to be swung about the pivot arm 22.

The connector arm 23, having a length longer than a width of the second frame tube 12, is arranged to rotatably passing through the second through hole 25 on the second frame tube 12 in such a manner that the second frame tube 12 is adapted to be swung about the connector arm 23.

According to the preferred embodiment, the pivot arm 22 and the connector arm 23 are rivets to securely mount on the first and second frame tubes 11, 12 respectively by penetrating through the first and second frame tubes 11, 12 respectively and forming an enlarged end portion to retain the first and second frame tubes 11, 12 in position, as shown in FIG. 3.

As shown in FIG. 3, the first axis 220 of the pivot arm 22 is defined as a y-axis and the second axis 230 of the connector arm 23 is defined as a x-axis which is perpendicularly to the first axis 220, wherein the first frame tube 11 is capable of rotatably moving within a x-z plane about the y-axis while the second frame tube 12 is capable of rotatably moving within a y-z plane about the x-axis. In other words, the folding joint arrangement can provide a two-plane movement for the first and second frame tubes 11, 12 pivotally connecting with each other.

Figure 4:
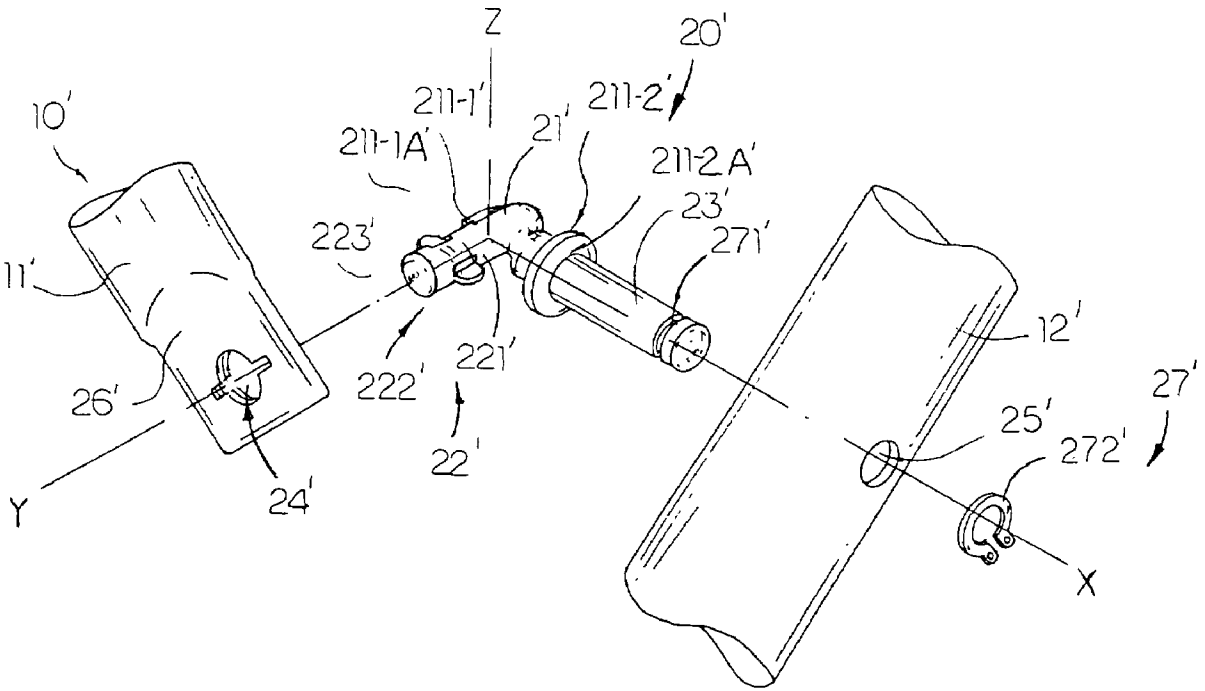
FIG. 4 illustrates a first alternative mode of the folding joint arrangement according to the above preferred embodiment of the present invention.
Figure 5:
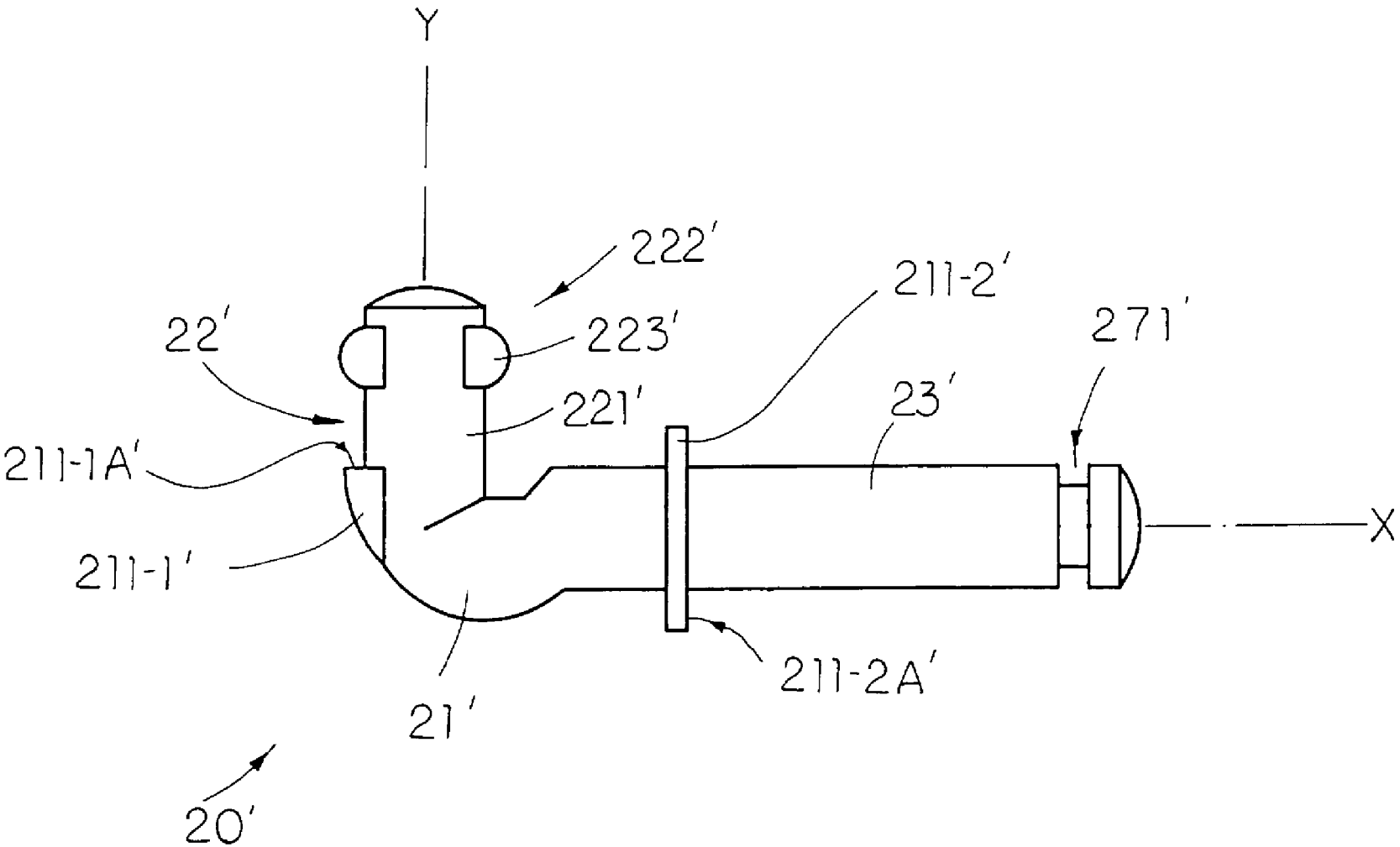
FIG. 5 is a front view of the first alternative mode of the folding joint arrangement according to the above preferred embodiment of the present invention.

FIGS. 4 and 5 illustrate a first alternative mode of the folding joint arrangement 20' which can be pivotally mounted on the first and second frame tubes 11', 12' with each other in a detachable manner.

The angle joint body 21' has two ends provided at two perpendicular directions, defined as an x-axis and a y-axis. A first and second enlarged end portions 211-1', 211-2' are provided at the two ends in a perpendicular manner to integrally connect with the pivot arm 22' and the connector arm 23' respectively. As embodied as an alternative mode as shown in FIGS. 4 and 5, the first enlarged end portion 211-1' is a protruding rib outwardly protruded therefrom that has a first biasing surface 211-1A' facing the pivot arm 22' that is immediately extended from the first enlarged end portion 211-1'. The second enlarged end portion 211-2' is a protruding ring radially protruded that has a second biasing surface 211-2A' facing the connector arm 23' that is immediately extended from the second enlarged end portion 211-2'. In other words, the first and second biasing surfaces 211-1A', 211-2A' of the two end portions 211-1', 211-2' of the angle joint body 21' are respectively arranged to bias against the first and second frame tubes 11', 12' when the first and second frame tubes 11', 12' are mounted to the pivot arm 22' and the connector arm 23' respectively.

As shown in FIG. 4, the pivot arm 22' has a neck portion 221' having a length slightly larger than a size of an end portion of the first frame tube 11', and an enlarged locker head 222' which is arranged for that when the neck portion 221' is rotatably passed through the first through hole 24', the locker head 222' of the pivot arm 22' is positioned at an outer side of the first frame tube 11', so as to retain the first frame tube 11' within the neck portion 221' of the pivot arm 22'.

The locker head 222' of the pivot arm 22' has at least a locking latch 223' outwardly extended therefrom and the first through hole 24' is shaped corresponding to the locker head 222' of the pivot arm 22' to have a central hole 241' having a diameter equal to or slightly larger than a diameter of the locker head 222' and at least a wing slot 242', having a size equal to or slightly larger than that of the locking latch 223', radially provided at a peripheral side of the central hole 241', wherein the central hole 241' and the wing slot 242' of the first through hole 24' are arranged in such a manner that the locker head 222' of the pivot arm 22' is fittedly passed through the first through hole 24' when the locking latch 223' is aligned with the wing slot 242'. Then, the first frame tube 11' can be locked up at the neck portion 221' of the pivot arm 22' by rotating the first frame tube 11' about the neck portion 221 ' of the pivot arm 22' to disalign the locking latch 223' of the locker head 222' of the pivot arm 22' with the wing slot 242' of the first through hole 24'. In other words, the end portion of the fist frame tube 11' is blocked by the locking latch 223' and retained between the first biasing surface 211-1A' and the locking latch 223'.

Accordingly, the folding joint arrangement 20' further comprises a reinforcing panel 26' integrally formed at the end portion of the first frame tube 11', wherein the first through hole 24' is formed on the reinforcing panel 26'. The reinforcing panel 26' is formed by flattening the end portion of the first frame tube 11 ' to reduce the size thereof in such a manner that the length of the neck portion 22' of the pivot arm 22' can be substantially reduced to just slightly larger than a thickness of the reinforcing panel 26'. In addition, once the end of the portion of the first frame tube 11 ' is flattened to form the reinforcing panel 26', the strength of the first frame tube 11' at the end portion will be rigidly increased so that when the pivot arm 22' is mounted to the first frame tube 11', the reinforcing panel 26' is capable of strengthening the connection between the first frame tube 11 ' and the pivot arm 22'.

It is worth to mention that in order to mount the pivot arm 22' to the first frame tube 11', the first frame tube 11 ' must be preferably positioned at a horizontal manner to match the shape of the first through hole 24' with the locker head 222' of the pivot arm 22'. Then, the first frame tube 11 ' is capable of rotating about the neck portion 221' of the pivot arm 22' to connect with other frame tube. Therefore, when the first frame tube 11' is moved between a folded position and an unfolded position of the foldable furniture, the first frame tube 11' cannot be detached from the pivot arm 22' since the first through hole 24' is mismatched with the locker head 222' of the pivot arm 22'. In other words, the first frame tube 11 ' is securely locked up with the pivot arm 22' by the shape of the locker head 222' thereof.

As shown in FIG. 4, the folding joint arrangement 20' further comprises means 27' for securely locking the connector arm 23' on the second frame tube 12', wherein the locking means 27' has a locking groove 271' indented on an outer circumferential surface of the connector arm 23' at an end portion thereof and comprises a locking ring 272' detachably mounted on the connector arm 23' along the locking groove 271' in such a manner that the second frame tube 12' is securely mounted on the connector arm 23' at a position between the angle joint body 21' and the locking ring 272'.

Accordingly, the locking ring 272' is a C-shaped mounting ring having elastic ability and is arranged in such a manner that when the connector arm 23' is slidably passed through the second through hole 25', the locking ring 272' is securely clamped on the connector arm 23' to slidably engage with the locking groove 271'. In other the folding joint arrangement 20' of the present invention can be simply connect the first and second frame tubes 11', 12' in a pivotally movable manner, so as to enhance the assembly of the foldable furniture 10'.

Figure 6A:
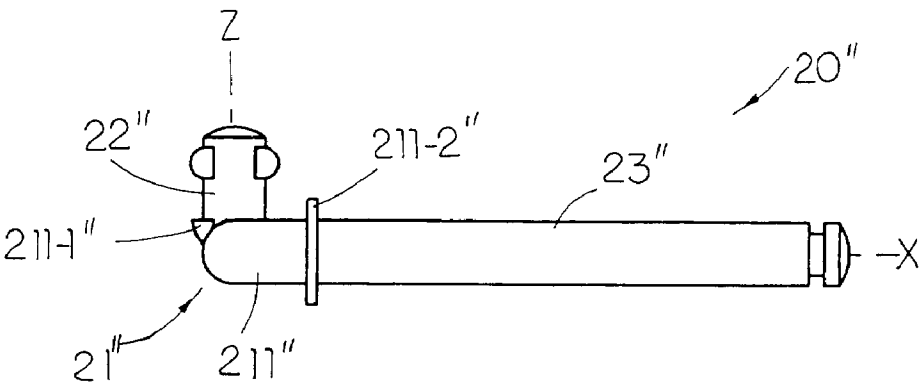
FIG. 6A is a front view of a second alternative mode of the folding joint arrangement according to the above preferred embodiment of the present invention.
Figure 6B:
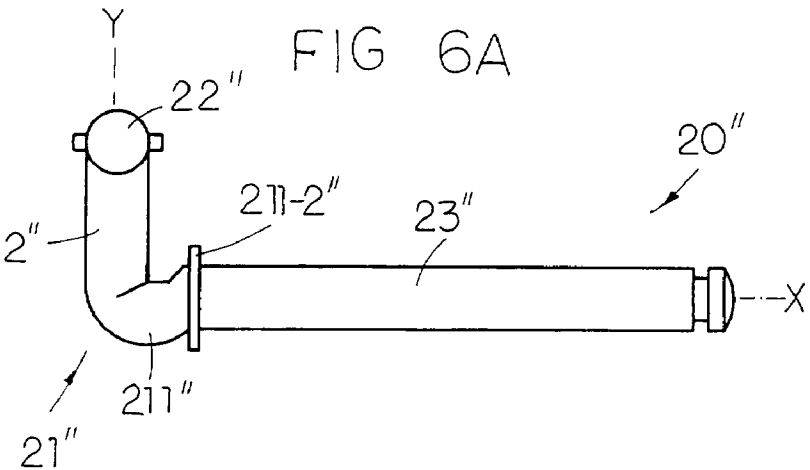
FIG. 6B is a plan view of the above second alternative mode of the folding joint arrangement according to the above preferred embodiment of the present invention.
Figure 6C:
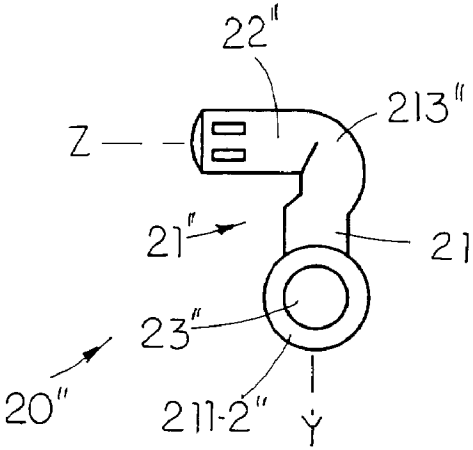
FIG. 6C is an end view of the above second alternative mode of the folding joint arrangement according to the above preferred embodiment of the present invention.

FIGS. 6A to 6C illustrate a second alternative mode of the above preferred embodiment of the present invention, which pivot arm 22" and connector arm 23" of the folding joint arrangement 20" are identical to the above first alternative mode, except that the angle joint body 21" is alternatively made to have three sections 211", 212", 213" extending along x-y-z three directions respectively so that the first and second enlarged end portions 211-1" and 211-2" are provided at two perpendicular directions defined as the x-axis and the z-axis respectively. Therefore, the first and second frame tube 11', 12' as shown in FIG. 4 can be connected to the pivot arm 22" and connector arm 23" as shown in FIGS. 6A to 6C in such a manner that the first frame tube 11' is capable of rotatably moving within a x-y plane about the z-axis while the second frame tube 12' is capable of rotatably moving within a y-z plane about the x-axis.

It is worth to mention that the folding joint arrangement 20, 20', according to the first and second embodiments, is capable of incorporating with any kind of foldable furniture, such as a foldable chair or a foldable table, constructed by the first and second frame tubes.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A folding joint arrangement comprising a folding joint for connecting a first frame tube with a second frame tube of a folding frame, wherein said folding joint comprises:

an angle joint body having a first end at a first axis and a second end at a second axis, wherein said first axis is perpendicular to said second axis;

a pivot arm which is integrally connected to said first end of said angle joint body and extended along said first axis for pivotally connecting with said first frame tube in such a manner that said first frame tube is capable of rotating about said first axis of said pivot arm, wherein said pivot arm has a neck portion and a locker head having at least a locking latch outwardly extended therefrom, wherein said neck portion has a length slightly larger than a size of said first frame tube adapted for positioning said locking latch at an outer side of said first frame tube when said neck portion is rotatably passed through a first through hole of said first frame tube so as to retain said first frame tube within said neck portion of said pivot arm;

a connector arm integrally connected to said second end of said angle joint body and extended along said second axis for pivotally connecting with said second frame tube in such a manner that said second frame tube is capable of rotating about said second axis of said connector arm so as to pivotally connect said first frame tube with said second frame tube, wherein said angle joint body has a first and second end portions provided at said first and second ends respectively and extended in a perpendicular manner to integrally connect with said pivot arm and said connector arm respectively, wherein said first end portion has a first biasing surface facing said pivot arm and said second end portion has a second biasing surface facing said connector arm for biasing against said first and second frame tubes when said first and second frame tubes are mounted to said pivot arm and said connector arm respectively so as to retain said first and second frame tubes in position on said pivot arm and said connector arm respectively; and means for securely locking said connector arm on said second frame tube, wherein said locking means has a locking groove indented on an outer circumferential surface of said connector arm at an end thereof and comprises a locking ring detachably mounted on said connector arm along said locking groove in such a manner that said second frame tube is securely mounted on said connector arm at a position between said angle joint body and said locking ring.

2. A folding joint arrangement comprising a folding joint connecting a first frame tube with a second frame tube of a folding frame, wherein said first frame tube has a first through hole transversely provided thereon and said second frame tube has a second through hole transversely provided thereon, wherein said folding joint comprises:

an angle joint body having a first end at a first axis and a second end at a second axis, wherein said first axis is perpendicular to said second axis;

a pivot arm integrally connected to said first end of said angle joint body and extended along said first axis, wherein said pivot arm is pivotally connected with said first frame tube in such a manner that said first frame tube is capable of rotating about said first axis of said pivot arm;

a connector arm integrally connected to said second end of said angle joint body and extended along said second axis, wherein said connector arm is pivotally connected with said second frame tube in such a manner that said second frame tube is capable of rotating about said second axis of said connector arm so as to pivotally connect said first frame tube with said second frame tube, wherein said angle joint body has a first and second end portions provided at said first and second ends respectively and extended in a perpendicular manner to integrally connect with said pivot arm and said connector arm respectively, wherein said first end portion has a first biasing surface facing said pivot arm and said second end portion has a second biasing surface facing said connector arm for biasing against said first and second frame tubes when said first and second frame tubes are mounted to said pivot arm and said connector arm respectively so as to retain said first and second frame tubes in position on said pivot arm and said connector arm respectively, wherein said pivot arm has a neck portion having a length slightly larger than a size of said first frame tube, and a locker head arranged to be positioned at an outer side of said first frame tube when said neck portion is rotatably passed through said first through hole, so as to retain said first frame tube within said neck portion of said pivot arm, wherein said locker head of said pivot arm has at least a locking latch outwardly extended therefrom and an end portion of said first frame tube has a central hole having a diameter at least equal to a size of said locker head so as to enable said locker head to pass through and at least a wing slot radially provided at a peripheral side of said central hole, wherein said wing slot has a size at least equal to that of said locking latch, wherein said central hole and said wing slot of said first through hole are arranged in such a manner that said locker head of said pivot arm is fittedly passed through said first through hole when said locking latch is aligned with said wing slot, and then said end portion of said first frame tube is locked up at said neck portion of said pivot arm by rotating said first frame tube about said neck portion of said pivot arm to disalign said locking latch of said locker head of said pivot arm with said wing slot of said first through hole, so that said end portion of said fist frame tube is blocked by said locking latch and retained between said first biasing surface and said locking latch; and means for securely locking said connector arm on said second frame tube, wherein said locking means has a locking groove indented on an outer circumferential surface of said connector arm at an end thereof and comprises a locking ring detachably mounted on said connector arm along said locking groove in such a manner that said second frame tube is securely mounted on said connector arm at a position between said angle joint body and said locking ring.

* * * * *